US005787664A

United States Patent [19]

Hollander et al.

[11] Patent Number: 5,787,664

[45] Date of Patent: Aug. 4, 1998

[54] HANDRAIL ASSEMBLY

[76] Inventors: Mark D. Hollander, 33781 Robles Dr., Dana Point, Calif. 92629; Ralph D. Martin, 6830 Johnson Ave., Long Beach, Calif. 90805

[21] Appl. No.: 804,789

[22] Filed: Feb. 24, 1997

[51] Int. Cl.[6] ..... E04F 11/18

[52] U.S. Cl. ..... 52/300; 52/184; 52/665; 256/65; 256/68; D08/363

[58] Field of Search ..... 52/184, 300, 730.1, 52/465, 712, 665, 730.7, 731.1; 256/59, 65, 68, 70; D08/363

[56] References Cited

U.S. PATENT DOCUMENTS

| | | | |
|---|---|---|---|
| 4,014,520 | 3/1977 | Walters | 256/59 X |
| 4,027,855 | 6/1977 | Lauzier | 256/59 X |
| 4,050,828 | 9/1977 | Noro | 256/65 X |
| 4,390,164 | 6/1983 | Cokelekoglu | 256/65 |
| 5,048,448 | 9/1991 | Yoder | 52/588.1 X |
| 5,553,427 | 9/1996 | Andres | 52/480 X |
| 5,649,588 | 7/1997 | Baker | 256/59 X |

FOREIGN PATENT DOCUMENTS

| | | | |
|---|---|---|---|
| 1180965 | 2/1970 | United Kingdom | 52/300 |

*Primary Examiner*—Robert Canfield
*Attorney, Agent, or Firm*—Stetina Brunda Garred & Brucker

[57] ABSTRACT

A handrail assembly and a handrail system incorporating the assembly. The handrail assembly includes a handrail which is a formed structure with an inner channel, and a mount structure accommodatable within the channel and having opposing substantially parallel members each having handrail engagement support members pliantly couplable with engagement support member acceptors within the channel. The handrail system incorporates the assembly and a base support structure extending from the mount structure. An expansive fill material can be introduced into the channel to substantially encapsulate the mount structure within the channel and provide protection from the environment. The handrail assembly provides a handrail structure and a mounting structure whereby the mounting structure is pliantly expandable and contractible to accommodate expansion non-compatibility of the mounting structure and the handrail structure due to temperature change. Because the mount structure is pliantly engaged with the handrail, differences in expansion and contraction rates are accommodated and absorbed by this pliant characteristic to thereby maintain the handrail in a securely mounted condition while preventing its fracture during ordinary use as well as ambient temperature changes.

19 Claims, 1 Drawing Sheet

10
12
3
3
36
38
38
38

10
12
14
34
27
30
26
27
16
29
32
40
28
38

10
12
44
27
16
27
18
14
30
20
32
29
29
24
22
14
34
42
40
38

14
30
32
26
28

HANDRAIL ASSEMBLY

FIELD OF THE INVENTION

This invention relates in general to handrails and grab bars, and in particular to a handrail assembly comprising a handrail structure and a mounting structure whereby the mounting structure is expandable and contractible to accommodate expansion non-compatibility of mounting structures and handrail structures in accord with characteristics of materials being used due to temperature change and thereby prevent fracture damage.

BACKGROUND OF THE INVENTION

The use of high-quality, low-maintenance material for certain applications including indoor and outdoor handrails and similar structures is desirable to create architectural and aesthetic effects for both residential and commercial settings. Non-limiting examples of such materials include marble, granite, glass, limestone, castings, extruded materials, synthetic solid surfacing materials such as Corian, manufactured by DuPont Co. of Wilmington, Del., and the like. While these materials by themselves are quite strong and durable, it is extremely difficult to successfully use them in an environment where ambient temperature change occurs. Specifically, these materials expand and contract in response to temperature changes at rates consistent with their respective characteristics. Likewise, any mounting structures mechanically fastened to these materials also expand and contract at rates consistent with the respective characteristics of the mounting structures. Consequently, when handrail material is rigidly mounted to such non-compatible mounting material, the high-quality handrail material or the mounting structure fractures upon temperature change and different rates of contraction and expansion. While using a pliable support such as rubber will accommodate such temperature changes, such a support does not provide adequate rigidity and also can result in the fracture of surfacing such as limestone and glass.

In view of the desirability to use high-quality material for handrail construction, it is apparent that a need is present for a handrail system that accommodates ambient temperature changes while permitting the available use of aesthetically pleasing, as well as practical, materials. Accordingly, a primary object of the present invention is to provide a handrail system that includes a formed handrail structure and a mounting structure that pliantly engage each other such that different rates of expansion and contraction do not impair or damage the handrail structure or the mounting structure.

Another object of the present invention is to provide a handrail system wherein the formed handrail structure has a channel in which a mounting structure can be disposed to engage the handrail structure.

These and other objects of the present invention will become apparent throughout the description which now follows.

SUMMARY OF THE INVENTION

The present invention is a handrail assembly and a handrail system incorporating the assembly. The handrail assembly includes as a first component thereof a handrail comprising a formed structure with an inner channel, with the channel having opposing side walls and engagement support member acceptors. A second component of the assembly is a mount structure accommodatable within the inner channel of the formed structure and comprising opposing substantially parallel members each having handrail engagement support members pliantly couplable with the engagement support member acceptors of the channel. As used herein, the term "pliantly couplable" means handrail support members having a flexible material disposed at interfacing surfaces of the support members and the handrail support member acceptor surfaces. Non-limiting examples of such a material include a rubber or silicone adhesive bead disposed along the support members destined to be in contact with handrail surfaces upon assembly of the handrail and mount structures. This construction provides a continuous fastening interface between the handrail and the mount to thereby provide continuous pliable support which itself is expandable and contractible without transferring such expansion or contraction between the handrail structure and its mount structure. The handrail system incorporates the assembly and a base support structure extending from the mount structure, and is non-limitedly exemplified by a series of balusters or spaced-apart posts secured to a ground site to thereby ultimately support the handrail. Should the handrail assembly be situated as a wall mounted rail, a base support structure can be a bracket secured to the wall. The mount structure can be a separate member attachable to the base support structure, or it can be the terminal portion of the base support structure. An expansive fill material can be introduced into the channel to substantially encapsulate the mount structure within the channel and provide protection from the environment.

The handrail assembly of the present invention provides a handrail structure and a mounting structure whereby the mounting structure is pliantly expandable and contractible to accommodate expansion non-compatibility of the mounting structure and the handrail structure due to temperature change in accord with characteristics of materials being used. Of particular importance is the opportunity to now use pleasing materials such as marble, granite, glass, limestone, and the like for handrail construction without the danger of destruction of such materials due to temperature change impact on the contraction and expansion rates of the handrail material as opposed to the mounting materials. Because the mount structure of the present invention is pliantly engaged with the handrail, differences in expansion and contraction rates are accommodated and absorbed by this pliant characteristic to thereby maintain the handrail in a securely mounted condition while preventing its fracture during ordinary use, ambient temperature changes, and other causes generally associated with prior art mounting attachments.

BRIEF DESCRIPTION OF THE DRAWINGS

An illustrative and presently preferred embodiment of the invention is shown in the accompanying drawings in which.

DETAILED DESCRIPTION OF THE PREFERRED EMBODIMENT

Figures 1, 2, 3, 4:
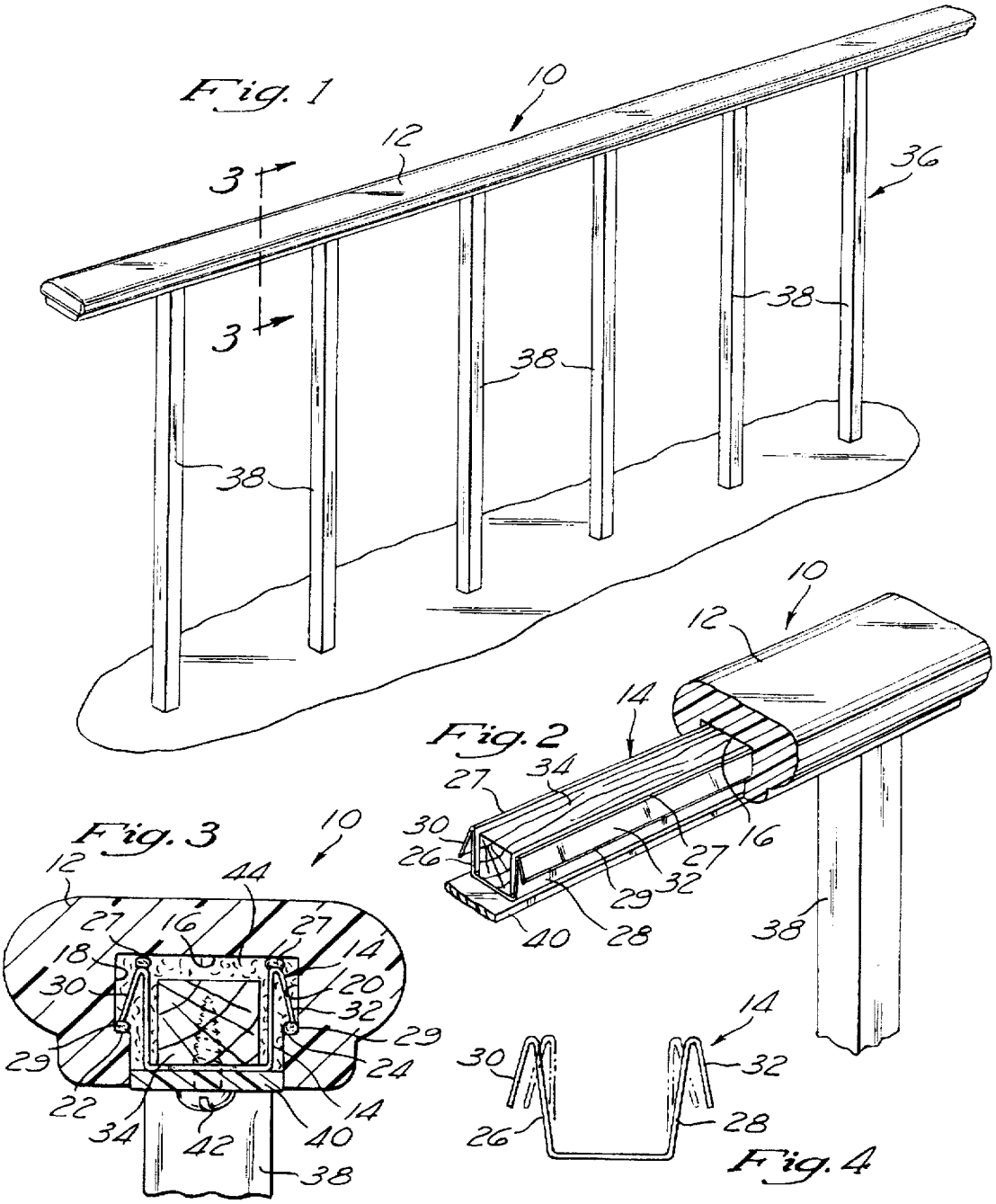
FIG. 1 is a perspective view of a handrail mounted to spaced-apart posts secured to the ground.
FIG. 2 is a perspective view of the handrail of FIG. 1 with a portion thereof cut away.
FIG. 3 is an end elevation view in section along line 3—3 of FIG. 1.
FIG. 4 is an end elevation view of a mount structure member.

Referring to FIGS. 1–4, a handrail system 10 is shown. The system 10 comprises, first of all, a handrail 12 and a mount structure 14, which together are a handrail assembly. The handrail 12 here shown is constructed of Corian (manufactured by DuPont Co. of Wilmington, Del.) and is a formed structure having an inner channel 16 with opposing side walls 18, 20 each provided with respective and opposing ridges 22, 24 operating as engagement support member acceptors. While Corian is illustrated, it is to be understood that other natural or synthetic material can be employed for construction of the handrail 12. As earlier related, non-limiting examples of such materials include marble, glass, limestone and granite. The mount structure 14 is a continuous length of 18-gauge galvanized steel in a U-configuration to thereby form opposing substantially parallel members 26, 28 each having outwardly extending flanges 30, 32 operating as handrail engagement support members. The mount structure 14 can also be constructed of extruded aluminum or other metal or plastic having similar flexibility characteristics to those of galvanized steel. A length of wood 34 is disposed between the parallel members 26, 28, but is not in contact with them. The length of wood 34 or similar material functions as an anchor as will be described later. An inherent characteristic of the galvanized steel or other material having similar characteristics is a pliant movability as found in the parallel members 26, 28 to thereby cause them to be springedly laterally movable as illustrated by the broken lines in FIG. 4. A first bead 27 of silicone adhesive or similar material is disposed along the top of each flange 30, 32, while a second identical bead 29 is disposed along the bottom of each flange 30, 32.

The handrail system 10 additionally includes a base support structure 36 extending from the mount structure 14 and comprised of a series of spaced-apart posts 38 secured to the ground. In the preferred embodiment, a continuous plate 40 is disposed along the respective tops of the posts 38 to provide a securement site for attaching the mount structure 14. Thus, as shown in FIG. 3, self-tapping screws 42 situated along the length of the plate 40 are driven through the plate 40 from beneath and into the length of wood 34 to thereby anchor the mount structure 14 to the base support structure 36. While the mount structure 14 is shown as a continuous length for the distance of the handrail system 10, it is to be noted that a plurality of short lengths of mount structure 14 can instead be employed, with such short lengths secured to the plate 40 preferably at generally uniform distances.

Operability of the system 10 is achieved by first providing the base support structure 36 with mount structure 14 secured thereto, and then installing the handrail 12 by aligning its inner channel 16 with the parallel members 26, 28 of the mount structure 14 and pushing the handrail 12 on to the mount structure 14. Because of the pliant properties of the mount structure 14, the parallel members 26, 28 move inwardly as the handrail 12 is forced over the mount structure 14, and then move laterally outwardly once inside the channel 16 such that the flanges 30, 32 engage the ridges 22, 24. As is shown in FIG. 3, the flanges 30, 32 have room for movement through the silicone beads 27, 29 while simultaneously retaining the handrail 12 in place. Consequently, as temperature changes occur, the handrail 12 can expand or contract at a rate different from that of the mount structure 14, yet still be securely retained. An expansive fill material 44 such as a silicone or expansive foam as known in the art can be introduced into the channel 16 after engagement with the mount structure 14 to substantially encapsulate the mount structure 14 within the channel 16 and accomplish a permanent, durable and waterproof encapsulation bond while maintaining required clearances and structural rigidity.

The concepts and principles exemplified in the preferred embodiment are applicable for ground supported handrails as here illustrated, as well as wall supported handrails, support bars, utility fixtures, and the like. Additionally, handrail configuration can include various shapes and designs including flush or raised mounts in relation to the base support structure 36, extended skirt structure of the handrail, etc. Thus, while an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A handrail system comprising:

a handrail comprising a formed structure having an inner channel which defines opposed sidewalls and engagement support member acceptors; and a mount structure disposed within the inner channel and comprising opposed, substantially parallel members which each include a handrail engagement support member pliantly coupled to a respective one of the engagement support member acceptors to provide continuous fastening along the length thereof, said mount structure being substantially encapsulated by an expansive fill material within the inner channel.

2. The handrail system of claim 1 further comprising a base support structure extending from the mount structure.

3. The handrail system of claim 1 wherein the fill material is chosen from a foam material and an epoxy material.

4. The handrail system of claim 1 wherein the parallel members of the mount structure are resiliently flexible.

5. The handrail system of claim 1 wherein the engagement support member acceptors extend along respective ones of the opposed sidewalls of the inner channel.

6. The handrail system of claim 1 wherein:

the engagement support member acceptors each comprise a ridge which extends along a respective one of the opposed sidewalls of the inner channel; and the handrail engagement support members each comprise a flange which extends outwardly from a respective one of the parallel members and is engageable to a respective one of the ridges.

7. The handrail system of claim 1 wherein the formed structure is constructed from a material selected from the group consisting of:

marble;

limestone;

glass;

granite; and synthetic solid surface materials.

8. A handrail assembly comprising:

an elongate mount structure including a pair of resiliently flexible flanges which extend in spaced relation to each other;

at least one bead applied to and extending substantially along each of the flanges; and an elongate handrail having a channel disposed therein which defines a pair of ridges extending in spaced relation to each other;

said handrail being securable to said mount structure via the receipt of the mount structure into the channel such that the flanges are cooperatively engaged to respective ones of the ridges and adhesively secured thereto via respective ones of the beads.

9. The handrail assembly of claim 8 wherein:

the channel defines a bottom surface and opposed side surfaces with the ridges being formed in an extending along respective ones of the side surfaces; and a pair of beads are applied to and extend substantially along each of the flanges;

the beads of each pair adhesively securing a respective one of the flanges to the bottom wall of the channel and a respective one of the ridges.

10. The handrail of claim 9 wherein each of the beads comprises a silicone adhesive.

11. The handrail assembly of claim 8 further comprising a base support structure, said mount structure being attached to said base support structure.

12. The handrail assembly of claim 11 further comprising an elongate anchor member extending along said mount structure for facilitating the attachment of the mount structure to the base support structure.

13. The handrail assembly of claim 12 wherein said base support structure includes an elongate plate and said mount structure is attached to said base support structure by the passage of multiple fasteners through said plate and said mount structure into said anchor member.

14. The handrail assembly of claim 13 wherein said base support structure further includes multiple posts extending therefrom in spaced relation to each other.

15. A handrail assembly comprising:

an elongate, generally U-shaped mount structure having a bottom wall, an opposed pair of sidewalls, and a pair of resiliently flexible flanges extending along respective ones of the sidewalls;

an elongate anchor member extending along the bottom wall of the mount structure in spaced relation to the sidewalls thereof; and an elongate handrail having a channel disposed therein which defines a bottom surface, opposed side surfaces, and a pair of ridges formed in and extending along respective ones of the side surfaces;

said handrail being securable to the mount structure via the receipt of the mount structure into the channel such that the flanges are cooperatively engaged to respective ones of the ridges.

16. The handrail assembly of claim 15 wherein said base support structure further includes multiple posts extending from said plate in spaced relation to each other.

17. The handrail assembly of claim 15 wherein each of the flanges includes at least one bead applied thereto and extending substantially therealong for adhesively securing each of the flanges to a respective one of the ridges.

18. The handrail assembly of claim 17 wherein each of the flanges includes a pair of beads applied thereto and extending substantially therealong for adhesively securing each of the flanges to a respective one of the ridges and to the bottom surface of the channel.

19. The handrail of claim 18 wherein each of the beads comprises a silicone adhesive.

* * * * *

UNITED STATES PATENT AND TRADEMARK OFFICE

CERTIFICATE OF CORRECTION

PATENT NO. : 5,787,664

DATED : Aug. 4, 1998

INVENTOR(S) : Mark D. Hollander

It is certified that error appears in the above-identified patent and that said Letters Patent is hereby corrected as shown below:

On the title page, item [56], insert the following:

U. S. PATENT DOCUMENTS

| EXAMINER INITIAL | | PATENT NUMBER | | | | | | | ISSUE DATE | PATENTEE | CLASS | SUBCLASS | FILING DATE IF APPROPRIATE |
|---|---|---|---|---|---|---|---|---|---|---|---|---|---|
| | | 3 | 9 | 9 | 1 | 9 | 8 | 2 | 11/16/76 | Y. Yamamoto | | | |
| | | 4 | 1 | 9 | 6 | 5 | 5 | 2 | 4/8/80 | G. F. Bartlett | | | |
| | | 4 | 2 | 2 | 0 | 3 | 1 | 6 | 9/2/80 | H. Naka et al. | | | |
| | | 4 | 2 | 5 | 6 | 2 | 8 | 7 | 3/17/81 | R. A. Birmingham | | | |
| | | 4 | 3 | 9 | 0 | 1 | 6 | 5 | 6/28/83 | R. H. Murdock | | | |
| | | 5 | 3 | 2 | 6 | 1 | 8 | 7 | 7/5/94 | R. L. Marie et al. | | | |
| | | 5 | 5 | 2 | 9 | 2 | 8 | 8 | 6/25/96 | L. Cheng-I | | | |
| | | 4 | 2 | 0 | 0 | 2 | 6 | 1 | 4/29/80 | G. F. Bartlett | | | |
| | | | | | | | | | | | | | |

Signed and Sealed this

Sixteenth Day of February, 1999

*Attest:*

*Attesting Officer*

*Acting Commissioner of Patents and Trademarks*